US010196844B2

(12) United States Patent
Bishop

(10) Patent No.: US 10,196,844 B2
(45) Date of Patent: Feb. 5, 2019

(54) VARIABLE RESISTANCE DOOR STAY APPARATUS

(71) Applicant: Electronic Power Design, Inc., Houston, TX (US)

(72) Inventor: Steve Bishop, Houston, TX (US)

(73) Assignee: Electronic Power Design, Inc., Houston, TX (US)

( * ) Notice: Subject to any disclaimer, the term of this patent is extended or adjusted under 35 U.S.C. 154(b) by 0 days.

(21) Appl. No.: 14/816,087

(22) Filed: Aug. 3, 2015

(65) Prior Publication Data

US 2016/0194908 A1 Jul. 7, 2016

Related U.S. Application Data

(60) Provisional application No. 62/100,899, filed on Jan. 7, 2015.

(51) Int. Cl.

| | |
|---|---|
| ***E05C 19/00*** | (2006.01) |
| ***E05C 21/00*** | (2006.01) |
| ***E05C 19/18*** | (2006.01) |
| ***E05C 17/28*** | (2006.01) |
| ***E05C 17/04*** | (2006.01) |
| *E05C 17/44* | (2006.01) |

(52) U.S. Cl.

CPC ..... *E05C 17/28* (2013.01); *E05C 17/04* (2013.01); *E05C 19/18* (2013.01)

(58) Field of Classification Search

CPC ..... E05C 19/18; E05C 19/182; E05C 19/184; E05C 19/186; E05C 19/188; E05C 17/047; E05C 17/042; E05C 17/28; E05C 17/04

USPC ..... 292/290, 291, 292, 297, DIG. 15, 292/DIG. 19, 338, 342, 345; 16/49, 16/DIG. 17, 82, 85, 86 B

See application file for complete search history.

(56) References Cited

U.S. PATENT DOCUMENTS

| | | | | | |
|---|---|---|---|---|---|
| 241,338 | A | * | 5/1881 | Escoubes | E05C 17/18 292/265 |
| 286,828 | A | * | 10/1883 | Keffer | E05C 17/28 292/274 |
| 734,575 | A | * | 7/1903 | Krubetke | E05C 17/28 292/274 |
| 1,057,774 | A | * | 4/1913 | Rich | E05C 17/28 217/60 C |
| 1,102,859 | A | * | 7/1914 | Blackwell | E05C 17/28 292/273 |
| 1,390,009 | A | * | 9/1921 | Arledge | E05C 19/182 292/297 |
| 1,408,236 | A | * | 2/1922 | Williams | E05C 17/28 217/60 C |

(Continued)

FOREIGN PATENT DOCUMENTS

| | | | | | |
|---|---|---|---|---|---|
| CH | 83833 | A | * | 1/1920 | E05C 17/28 |
| CH | 113117 | A | * | 1/1926 | E05C 17/28 |

(Continued)

*Primary Examiner* — Kristina R Fulton
*Assistant Examiner* — Faria F Ahmad
(74) *Attorney, Agent, or Firm* — G. Michael Roebuck, PC

(57) ABSTRACT

A variable resistance door stay apparatus is disclosed. The door stay is provided with an adjustable tightening nut that slides inside a longitudinal slot in a ridged member. A method is disclosed for proving variable resistance to rotational of a door.

10 Claims, 4 Drawing Sheets

(56) References Cited

U.S. PATENT DOCUMENTS 1,497,039 A * 6/1924 Springborn ..... E05C 19/182 292/292
1,599,263 A * 9/1926 Woodhull ..... E05C 17/28 292/267
1,737,397 A * 11/1929 Williamson ..... E05C 17/28 292/272
2,664,590 A * 1/1954 Allen ..... E05C 17/28 16/65
2,945,255 A * 7/1960 Ellis ..... E05C 17/28 16/49
3,100,122 A * 8/1963 Knapp ..... E05B 77/00 292/266
3,429,151 A * 2/1969 Weingart ..... E05C 19/182 292/290
3,664,164 A * 5/1972 Zaidener ..... B60R 25/0221 70/14
4,019,765 A * 4/1977 Nichola ..... E05C 19/004 248/354.4
4,290,635 A * 9/1981 McKenzie ..... E05C 19/182 292/290
4,639,969 A * 2/1987 Obenshain ..... E05F 3/221 16/65
4,750,236 A * 6/1988 Teague, Jr. ..... E05C 17/28 16/49
4,815,163 A * 3/1989 Simmons ..... E05F 3/221 16/49
4,858,972 A * 8/1989 Salyer ..... E05C 19/004 292/338
4,958,867 A * 9/1990 Champagne ..... D06F 39/14 292/258
5,083,342 A * 1/1992 Klinefelter ..... E05F 3/223 16/66
5,531,491 A * 7/1996 Skelton ..... E05C 19/182 292/291
6,253,417 B1 * 7/2001 Rusiana ..... E05C 17/28 16/65
6,755,450 B1 * 6/2004 Chen ..... E05C 19/182 292/289
8,276,317 B2 * 10/2012 Williams ..... E05C 17/48 292/262
2009/0044578 A1 * 2/2009 Boss ..... E05B 73/0082 70/57
2012/0036781 A1 * 2/2012 Runk ..... E05C 17/24 49/181

FOREIGN PATENT DOCUMENTS

CH 377679 A * 5/1964 ..... E05C 17/28
DE 335147 C * 3/1921 ..... E05C 17/28
DE 345933 C * 12/1921 ..... E05C 17/28
EP 1020598 A2 * 7/2000 ..... E05C 17/28
FR 330157 A * 8/1903 ..... E05C 17/28
FR 471129 A * 10/1914 ..... E05C 17/28
FR 1302081 A * 8/1962 ..... E05C 17/085
FR 2044568 A5 * 2/1971 ..... E05C 17/085
GB 159415 A * 3/1921 ..... E05C 17/28
GB 214186 A * 4/1924 ..... E05C 17/28
GB 229522 A * 2/1925 ..... E05C 17/28
GB 243959 A * 12/1925 ..... E05C 17/28
GB 246075 A * 1/1926 ..... E05C 17/28
GB 475339 A * 11/1937 ..... E05C 17/28
GB 1312231 A * 4/1973 ..... E05C 17/28

* cited by examiner

VARIABLE RESISTANCE DOOR STAY APPARATUS

CROSS REFERENCE TO RELATED APPLICATIONS

This application claims priority from U.S. Provisional Application Ser. No. 62/100,899 filed on Jan. 7, 2015 by Steve Bishop and entitled "Variable Resistance Door Stay Apparatus" which is hereby incorporated by reference herein in its entirety.

FIELD OF THE INVENTION

The present invention relates to the field door of door stays.

SUMMARY OF THE INVENTION

A variable resistance door stay apparatus is disclosed. The door stay is provided with an adjustable tightening nut that slides inside a longitudinal slot in a ridged member.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF AN ILLUSTRATIVE EMBODIMENT

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
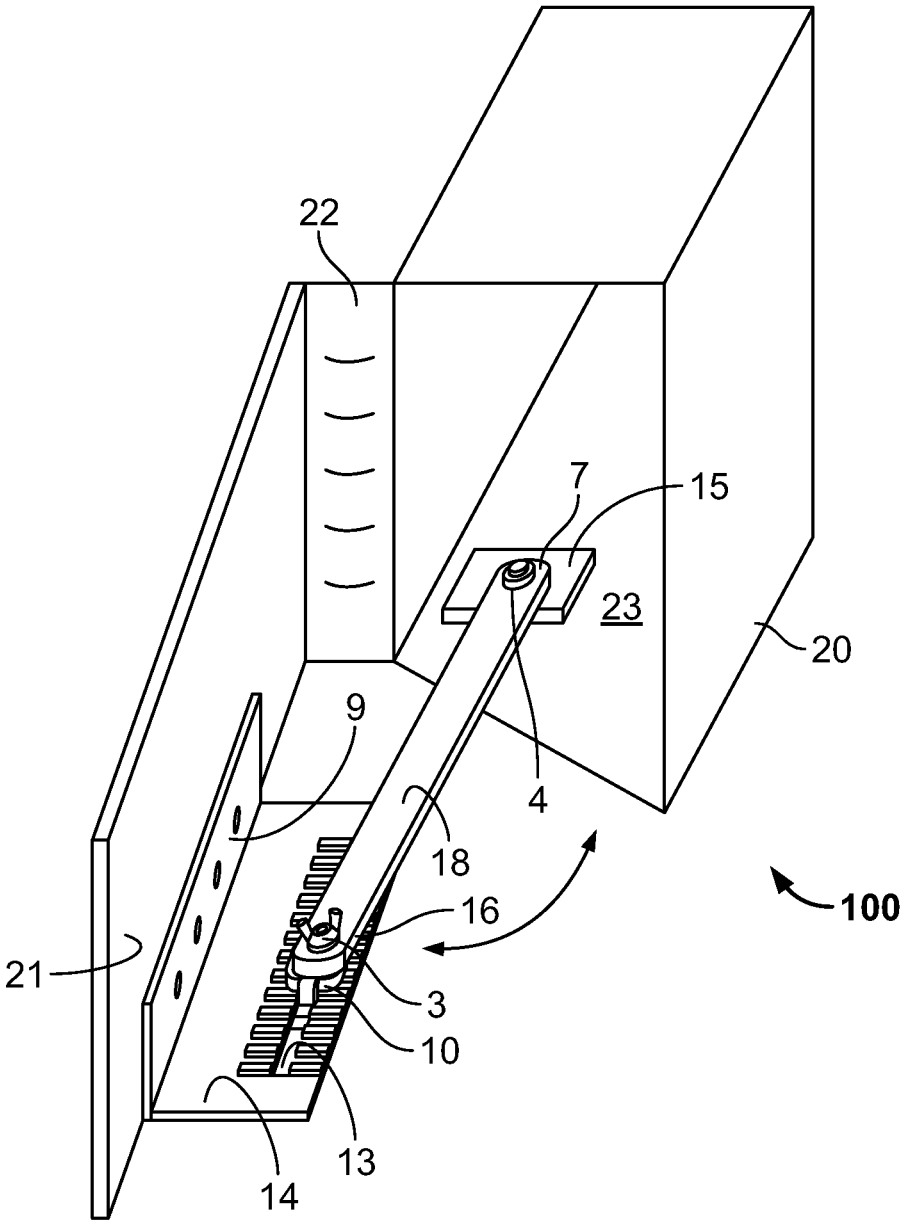
FIG. 1 is orthographic projection of an illustrative embodiment of the invention installed on a cabinet body and cabinet door.

An illustrative of a variable resistance door stay apparatus is disclosed. Turning now to FIG. 1, FIG. 1 is orthographic projection of an illustrative embodiment 100 of the invention installed to provide a variable resistance door stay on a cabinet door. The cabinet body 20 and the cabinet door 21 are rotationally attached by hinge 22. The hinge is attached to the cabinet body 23 and to the cabinet door 21. The variable resistance door stay 200 is described with more detail below and depicted in more schematic detail below in FIGS. 2-4. The variable resistance door stay apparatus 200 is attached to and between the cabinet body 20 and the cabinet door 21. As the cabinet door rotates about a rotational axis provided by hinge 22, a door stay arm 18 rotates on one end about axis rod 4 and slides in slot 13 on the other end of the door stay arm 18. The axis rod is attached to the floor 23 of the cabinet body by plate 15.

In a particular illustrative embodiment, the variable resistance door stay operates in three levels of resistance to door rotation, minimum, medium and maximum. Tightening of the wing nut determines the level of resistance provided by the variable resistance door stay. Thus, in another embodiment, the variable resistance door stay provides a large number of levels of resistance to door rotation, depending the amount of tightening of the wing nut. In this example the level of resistance is proportional to the degree of tightening of the wing nut. In a particular embodiment the wing nut is tightened between 0 and 100% of maximum tightening to provide a level or resistance between 0 and 100%. The wing nut is 100% tightened when it cannot be tightened any more. In the present example a level or resistance of 0% is referred to as the "free" mode of operation. In the free mode, the wing nut is tightened at 0% (minimum) and the level of resistance is 0 or minimum. In the free mode, the wing nut is loose and the ridges of the door stay are not engaged. In the free mode, the variable resistance door stay 200 is not tightened in slot 13 and the slide guide slides freely with minimum resistance in slot 13 formed in ridged slotted member 14 as the cabinet door 21 rotates on the hinge 22.

In a second mode of operation, referred to as the medium mode, the wing nut is tightened to a medium and the slide guide is tightened to medium in slot 13 and does not slide freely in the slot 13. In the medium mode, the wing nut is tightened at 50% and the level of resistance to the slide guide sliding in the slot is 50%. In the medium mode, the ridges of the door stay are 50% engaged and provide 50% or medium resistance to the slide guide sliding in the slot door rotation which resists door rotation at a medium level.

In a third mode of operation, referred to as the maximum mode, the variable resistance door stay is tightened in slot 13 and does not slide freely in the slot 13. In the maximum mode, the wing nut is tightened at 100% and the level of resistance is 100%. In the maximum mode, the ridges of the door stay are 100% engaged and provide 100% or maximum resistance to the slide guide sliding in the slot and to door rotation. Thus, the tightened door stay apparatus 200 resists rotation of the cabinet door on the hinge attaching the cabinet door to the cabinet body.

Figure 2:
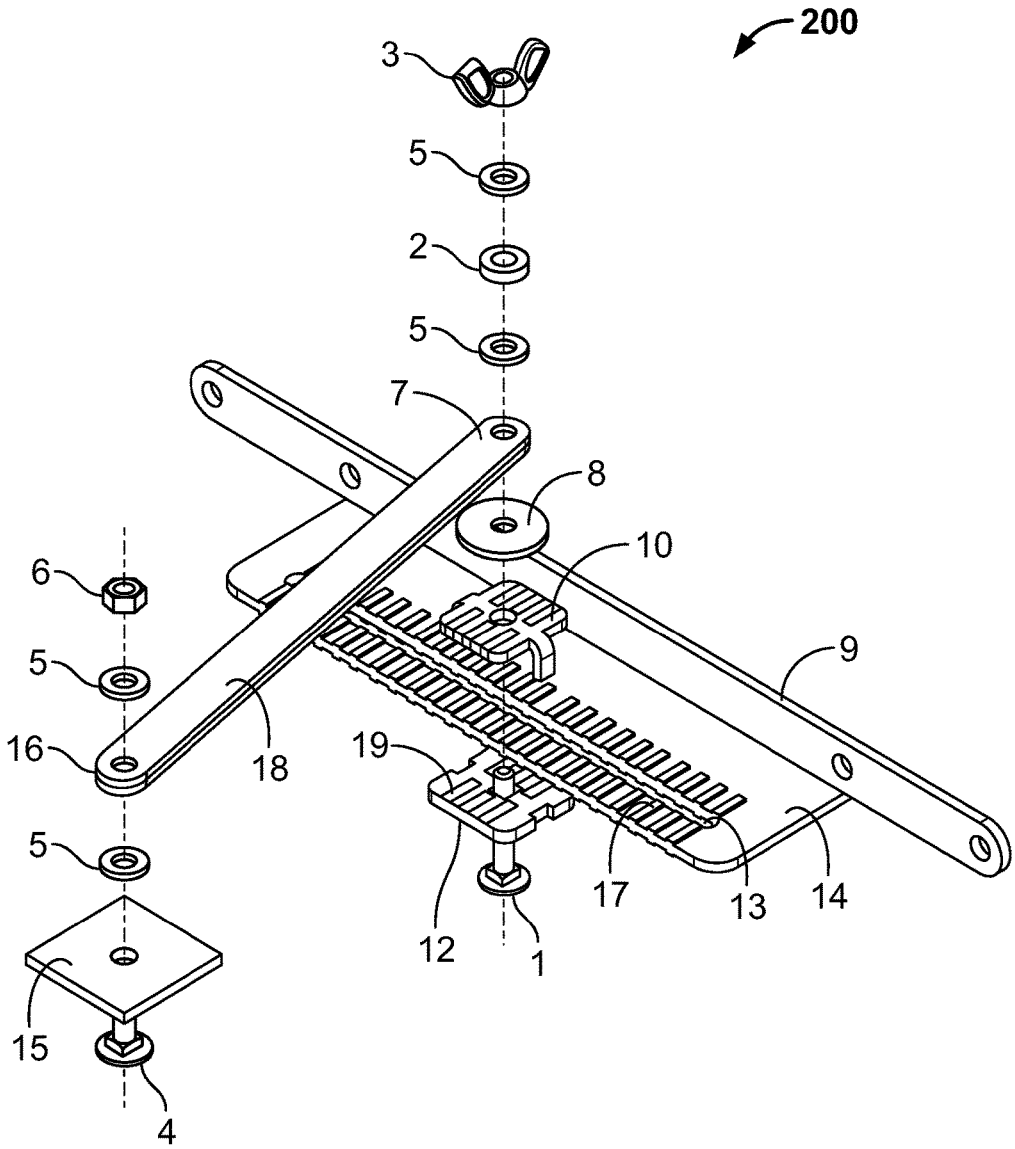
FIG. 2 is exploded view of an illustrative embodiment of the invention showing the variable resistance door stay apparatus.

FIG. 2 is schematic depiction exploded view of an illustrative embodiment 200 of the invention showing the variable resistance door stay apparatus. Turning now to FIG. 2, as shown in FIG. 2 the door stay apparatus is provided with an adjustable tightening nut apparatus comprising a tightening bolt 1, a rubber cushioning bushing 2, a wing nut 3, washers 5, rotation bushing 8, ridged slide guide 10 having tabs 11 wherein the tabs are directed downward and perpendicular to a horizontal plane for an upper surface of a rigid slotted member 14 and ridged slide guide mate 12 the slide guide mater having tab slots 19 that mate with tabs 11. The tabs fit into the tab slots and prevent rotation of the ridged sleeve guide 10. The ridged slotted member has ridges 17 adjacent slot 13 on the top and bottom of the ridged slotted member (see FIG. 4). In another particular embodiment, the ridged slotted member ridges are replaced by rough sand paper like friction generating surfaces that, similar to the ridges, resist linear motion when engaged, however to a lesser degree. In another particular embodiment, the ridged slotted member ridges are replaced by smooth surfaces that, similar to the ridges, resist linear motion when engaged, however to a lesser degree. In all instances, the terms "slotted member" and the "ridged slotted member" refer a slotted member has one of three surfaces described as ridges, rough and smooth.

As wing nut 3 is tightened, the tabs 11 protrude through the slot 13 as the tabs are oriented at a perpendicular angel to the horizontal plane of the ridged slotted member and penetrate through the slot 13 and fit into the tab slots 19. Resistance to door rotation is provided by ridges 25 on the bottom of ridged slide guide 10 (see FIG. 4) engaging the ridges 17 on the top of ridged slotted member and ridges 19 on the top of ridged slide guide mate 12 engage the ridges 23 on the bottom of ridged slotted member (see FIG. 4). When wing nut 3 is not tightened, the adjustable tightening nut apparatus slides inside the longitudinal slot 13 formed in ridged slotted member 14 as a first end 7 of the door stay arm 18 rotates on axis rod 4 as the other end 16 of the door stay arm attached to a slide guide slides in slot 13. Resistance to motion of the slide guide in the slot also provides resistance to the first end of the door stay arm from rotating and resists rotation of the cabinet door to which the door stay arm is attached.

In a particular illustrative embodiment, the ridged slotted member 14 is attached on a plane perpendicular to the front planar surface of the cabinet door 21. The cabinet door is rotationally hinged to the cabinet body 20. In a particular embodiment, the hinge 22 runs vertically along a vertical edge of the cabinet door and the cabinet body. A plate 15 is attached to the cabinet body. The plate 15 has a hole through which with an axis rod 4 slides through the plate and forms a rotation axis for rigid arm 15. In the present example the axis rod has a longitudinal axis parallel to the rotational axis of the hinge. The door 21 rotates on the hinge 22. A first end 7 of the door stay arm 18 is rotationally connected to the axis rod 4. A second and opposite end 16 of the door stay arm 18 is rotationally attached to a slide guide 10 that slides along slot 13 formed attached to the ridged slotted member 14. The second end attached to the slide guide slides freely in slot when the variable resistance member is loose allowing free rotational movement of the door around a rotational axis of the hinge as the door swings open and away from the cabinet. The second end is rotationally attached to the variable resistance member. In a particular embodiment, the variable resistance member that slides relatively fixed in the slot when the variable resistance member is tightened, resisting free rotational movement as the door prevented from rotating open and away from the cabinet body or rotating shut and back to the cabinet body. In one example the variable resistance door stay is set to a medium resistance setting by tightening bolt 3 is tightened to medium resistance setting at 50% of a maximum tightening for tightening bolt 3. In this medium resistance setting for the variable resistance door stay, the door stays in a fixed position. In the medium resistance setting light forces on the door do not cause the door to rotate. For example, in the medium resistance setting, a light wind does not create enough force to overcome a resistance to cabinet door rotation, provided by the variable resistance door stay in the medium resistance setting. Resistance is provided by the tightened tightening wing nut 3 to resisting sliding of the second end 16 or door stay arm 18 along the slot 13 provided by the medium resistance provided by the variable resistance door stay. Thus, the force on the cabinet door created by a light wind does not blow the door further open or shut, however, when a stronger force is place on the door, such as a person running into the door, the force of the person on the cabinet door is sufficient to overcome the medium resistance provided by the variable resistance member. In the medium resistance setting, the variable resistance door stay gives way to the force of the person running into the door thereby preventing injury to the person. The giving way to the force of the person running into the door also avoids breaking the door stay when the person runs into the door.

In another particular embodiment, the ridged slotted member is a linear motion member (also referred to as a ridged slotted member) that accepts the slide guide but does not have a slot to guide the slide guide. In this alternative illustrative embodiment, the slide guide slides along the linear motion member and is guided by any available apparatus to keep the slide guide on a linear path along a longitudinal axis of the linear motion member. One alternative embodiment of the invention provides a slide guide that has arms that reach around the linear motion member to keep the slide guide on a sliding path along the longitudinal axis of the linear motion member.

Figure 3:
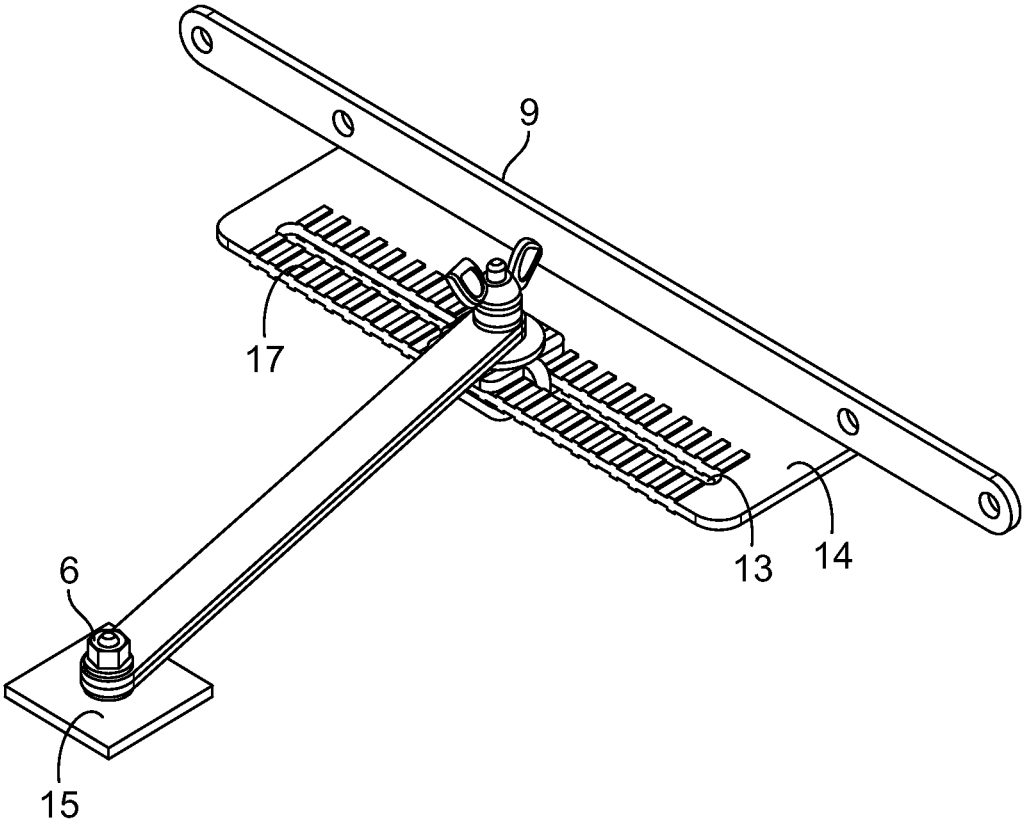
FIG. 3 is assembled view of an illustrative embodiment of the invention showing the variable resistance door stay apparatus.
Figure 4:
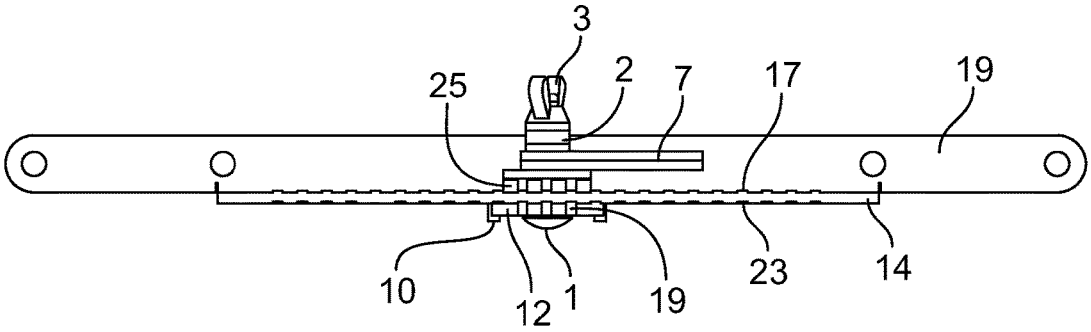
FIG. 4 is side view of the variable resistance door stay apparatus.

FIG. 3 is assembled view of an illustrative embodiment of the invention showing the variable resistance door stay apparatus. FIG. 4 is side view of the variable resistance door stay apparatus. As shown in FIG. 4, wing nut 3 is used to tighten a first end of the door stay arm 7, the ridged slot glide 10, and ridged slot guide mate 12. The first ridges 17 on a top surface of the ridged slotted member engage the second ridges 25 on the slot glide. The second ridges 23 on a bottom surface of the ridged slotted member engage ridges 19 on a top surface of the slot guide mate 12.

In an particular illustrative embodiment includes but is not limited to a door stay including but not limited to a cabinet comprising a cabinet body, a hinge and a cabinet door, wherein the hinge is rotationally attached between the cabinet body and the cabinet door; a door stay arm attached between the cabinet body and the cabinet door; an axis rod attached to the cabinet body, wherein a first end of the door stay arm is rotationally attached to the axis rod; a slotted member, attached to the cabinet door, wherein a first end of the door stay arm is rotationally attached to a slide guide in a slot in the slotted member; and an adjustable resistance apparatus that applies an adjustable force to the slide guide that resists linear motion of the slide guide in the slot to resist rotational motion of the hinged cabinet door about a rotational axis for the hinge.

In another particular embodiment, the adjustable resistance apparatus is a wing nut. In another particular embodiment, the door stay further includes but is not limited to first ridges formed on a top surface of the slotted member that adjustably engage second ridges on the slide guide, wherein the engaged first and second ridges resist linear motion of the slide guide in the slot. In another particular embodiment, the first ridges engage the second ridges adjustably engage each other and provide a variable resistance to the linear motion of the slide guide in the slot that is proportional to the adjustable force applied by the variably tightening the adjustable resistance apparatus In another particular embodiment, the door stay further includes but is not limited to the adjustable resistance apparatus is tightened to provide minimum resistance to rotation of the cabinet door.

In another particular embodiment, the adjustable resistance apparatus is tightened to provide medium resistance to rotation of the cabinet door, wherein the medium resistance is sufficient to resist rotation of the cabinet door from a light force acting on the cabinet door. In another particular embodiment, the medium resistance is not sufficient to resist rotation of the cabinet door from a medium force greater than the light force acting on the cabinet door. In another particular embodiment, the medium force acting on the cabinet door overcomes the medium resistance to rotation of the cabinet door and allows the cabinet door to rotate to avoid damage to the door stay. In another particular embodiment, the medium force acting on the cabinet door overcomes the medium resistance to rotation of the cabinet door and allows the cabinet door to rotate to avoid damage to a person running into the cabinet door.

In another particular embodiment, the adjustable resistance apparatus provides maximum resistance to rotation of the cabinet door. In another particular embodiment, the door stay further includes but is not limited to third ridges formed on a bottom surface of the slotted member that adjustably engage fourth ridges on a slide guide mate, wherein the engaged third and fourth ridges resist linear motion of the slide guide in the slot. In another particular embodiment, the third ridges engage the fourth ridges adjustably engage each other and provide a variable resistance to the linear motion of the slide guide in the slot proportional to adjustable force applied by the adjustable resistance apparatus.

In another particular embodiment, the a method is disclosed that includes but is not limited to tightening an adjustable resistance apparatus to a slide guide that resists linear motion of the slide guide in a slot to resist rotational motion of a hinged cabinet door about a rotational axis for the hinge. In another particular embodiment of the method, the cabinet door is hinged to a cabinet comprising a cabinet body, wherein a door stay arm attached between the cabinet body and the cabinet door, an axis rod attached to the cabinet body, wherein a first end of the door stay arm is rotationally attached to the axis rod, a slotted member, attached to the cabinet door, wherein a first end of the door stay arm is rotationally attached to a slide guide in a slot in the slotted member and the adjustable force, the method further including but not limited to applying an adjustable force to the slide guide by tightening an adjustable resistance apparatus that applies to the slide guide that resists linear motion of the slide guide in the slot to resist rotational motion of the hinged cabinet door about a rotational axis for the hinge.

In another particular embodiment, applying the adjustable force further includes but is not limited to tightening a wing nut that applies the adjustable force to slide guide. In another particular embodiment, applying the adjustable force further includes but is not limited to applying an adjustable force further comprises loosening a wing nut that applies the adjustable force to slide guide. In another particular embodiment, the slotted member further comprises first ridges formed on a top surface of the slotted member that adjustably engage second ridges on the slide guide, wherein the engaged first and second ridges resist linear motion of the slide guide in the slot, the method further including but not limited to variably tightening the adjustable resistance apparatus, wherein the first ridges engage the second ridges adjustably engage each other and provide a variable resistance to the linear motion of the slide guide in the slot that is proportional to the adjustable force applied by the variably tightening the adjustable resistance apparatus.

In another particular embodiment of the method, the ridged slotted member further includes but is not limited to third ridges formed on a bottom surface of the slotted member and fourth ridges on a slide guide mate, that adjustably engage each other, wherein the engaged third and fourth ridges resist linear motion of the slide guide in the slot, the method further including but not limited to applying an adjustable force applied by the adjustable resistance apparatus to the slide guide and slide guide mate, wherein the third ridges engage the fourth ridges adjustably engage each other and provide a variable resistance to the linear motion of the slide guide in the slot proportional to adjustable force applied by the adjustable resistance apparatus. In another particular embodiment further includes but is not limited to tightening the adjustable resistance apparatus to provide medium resistance to rotation of the cabinet door, wherein the medium resistance is sufficient to resist rotation of the cabinet door from a light force acting on the cabinet door. In another particular embodiment further includes but is not limited to tightening the adjustable resistance apparatus to provide minimum resistance to rotation of the cabinet door.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The foregoing description of an illustrative embodiment of the present invention has been presented for the purpose of illustration and description. It is not intended to be exhaustive or to limit the invention to the precise form disclosed. Many modifications and variations are possible in light of the above teachings. Figures are also merely representational and may not be drawn to scale. Certain proportions thereof may be exaggerated, while others may be minimized. It is intended that the scope of the present invention not be limited by this detailed description, but by the claims and the equivalents to the claims appended hereto.

The invention claimed is:

1. A door stay comprising:

a door stay attached to a cabinet comprising a cabinet body, a hinge and a cabinet door, wherein the hinge is rotationally attached between the cabinet body and the cabinet door;

a ridged slotted member attached to the cabinet body and a door stay arm, wherein a set of first ridges formed on a top surface of the ridged slotted flat member adjustably engage second ridges on a ridged slide guide the ridged slotted member at a perpendicular angle to a top surface of the ridged slotted flat member, wherein the engaged first and second ridges resist linear motion of the ridged slide guide along the linear motion member;

an axis rod having a first end attached to the cabinet body, wherein a first end of the door stay arm is rotationally attached to the axis rod;

a second end of the door stay arm is rotationally attached to the ridged slide guide, wherein the slide guide slides longitudinally an open area forming a longitudinal slot in the ridged slotted member; and an adjustable resistance apparatus that applies an adjustable force perpendicular to a horizontal plane for an upper surface of the ridged slide guide and provides adjustable resistance and resists linear motion of the slide guide along the longitudinal slot to resist rotational motion of the hinged cabinet door about a rotational axis for the hinge, wherein the ridged slide guide has tabs that are oriented in a perpendicular to the horizontal plane of the upper surface of the ridged slide guide, wherein the tabs penetrate through the slot and fit into tab slots formed on a ridged slide guide mate.

2. The door stay of claim 1, wherein the first ridges engage the second ridges adjustably engage each other and provide a variable resistance to the linear motion of the slide guide along the longitudinal axis of the linear motion ember that is proportional to the adjustable force applied by the variably tightening the adjustable resistance apparatus.

3. The door stay of claim 2, wherein the adjustable resistance apparatus is tightened to provide minimum resistance to rotation of the cabinet door.

4. The door stay of claim 2, wherein the adjustable resistance apparatus is tightened to provide medium resistance to rotation of the cabinet door, wherein the medium resistance is sufficient to resist rotation of the cabinet door from a light force acting on the cabinet door.

5. The door stay of claim 4, wherein the medium resistance is not sufficient to resist rotation of the cabinet door from a medium force greater than the light force acting on the cabinet door.

6. The door stay of claim 5, wherein the medium force acting on the cabinet door overcomes the medium resistance to rotation of the cabinet door and allows the cabinet door to rotate to avoid damage to the door stay.

7. The door stay of claim 5, wherein the medium force acting on the cabinet door overcomes the medium resistance to rotation of the cabinet door and allows the cabinet door to rotate to avoid damage to a person running into the cabinet door.

8. The door stay of claim 2, wherein the adjustable resistance apparatus provides maximum resistance to rotation of the cabinet door.

9. The door stay of claim 3, further comprising:

third ridges formed on a bottom surface of the slotted member that adjustably engage fourth ridges on a slide guide mate, wherein the engaged third and fourth ridges resist linear motion of the slide guide in the slot.

10. The door stay of claim 9, wherein the third ridges engage the fourth ridges adjustably engage each other and provide a variable resistance to the linear motion of the slide guide in the slot proportional to adjustable force applied by the adjustable resistance apparatus.

* * * * *